US005627572A

United States Patent [19]

Harrington, III et al.

[11] Patent Number: 5,627,572

[45] Date of Patent: May 6, 1997

[54] PROGRAMMABLE HEAD TYPE DETECTION AND MAINTENANCE SYSTEM

[75] Inventors: Paul Harrington, III, Versailles; Edmund H. James, III, Lexington; Randall D. Mayo, Georgetown, all of Ky.

[73] Assignee: Lexmark International, Inc., Lexington, Ky.

[21] Appl. No.: 386,590

[22] Filed: Feb. 10, 1995

Related U.S. Application Data

[63] Continuation-in-part of Ser. No. 327,935, Oct. 24, 1994.

[51] Int. Cl.[6] ..... B41J 2/165

[52] U.S. Cl. ..... 347/23; 347/33; 347/35; 347/87

[58] Field of Search ..... 347/22, 23, 29, 347/30, 32, 33, 35, 88, 24, 43, 87, 49

[56] References Cited

U.S. PATENT DOCUMENTS

| | | | |
|---|---|---|---|
| 4,930,915 | 6/1990 | Kikuchi et al. | 400/175 |
| 5,103,244 | 4/1992 | Gast et al. | 347/33 |
| 5,138,344 | 8/1992 | Ujita | 347/86 |
| 5,296,876 | 3/1994 | Yamaguchi et al. | 347/23 |
| 5,363,134 | 11/1994 | Barbehenn et al. | 347/49 |
| 5,495,271 | 2/1996 | Koitabashi et al. | 347/23 |

FOREIGN PATENT DOCUMENTS

| | | | |
|---|---|---|---|
| 416849 | 12/1994 | European Pat. Off. | 347/33 |
| 59-207259 | 11/1984 | Japan | 347/23 |
| 5-270008 | 10/1993 | Japan | 347/23 |

*Primary Examiner*—John E. Barlow, Jr.

*Attorney, Agent, or Firm*—B. Franklin Griffin, Jr.

[57] ABSTRACT

An ink-jet printer is provided with a printhead maintenance system which is capable of providing optimum maintenance for different types of color or monochrome printheads. Dummy heaters are provided in each printhead as a way of identifying the different types of printheads. A maintenance controller is provided in the printer for executing a maintenance program comprising first and second maintenance algorithms for controlling maintenance of monochrome and color type printheads. The controller includes an $E^2$PROM memory into which descriptor records are downloaded from a data processor to which the printer is connected. Each descriptor record contains a head detection pattern and various parameters specifying the number and time of wipes, the number of nozzle fires, etc. necessary to maintain a head of the type corresponding to the head detection pattern. When the printer is turned on, or a new printhead is installed, the pattern of heaters is sensed, compared to the head detection patterns in the descriptor records, and the parameters in the descriptor record having a head detection pattern best matching the sensed pattern of heaters are used in executing the maintenance program. The memory may be updated with new descriptor records thereby permitting proper maintenance of printheads developed subsequent to the design of the maintenance system.

13 Claims, 6 Drawing Sheets

110
INSTALL / CHANGE PRINTHEAD
UNCAP PRINTHEAD
111
112
OLD HEAD MONOCHROME ?
Y
N
113
ONE WIPE
114
GO TO LOAD POSITION
115
5 MIN. ?
Y
N
116
INSTALL ?
N
Y
GO TO HOME CAP PRINTHEAD
118
100
POR
101
GET HEAD TEST DATA
102
FIND BEST MATCH
105
RETRIEVE DESCRIPTOR RECORD
106
UNCAP PRINTHEAD
107
HEAD TYPE = COLOR ?
N
5
Y
6A

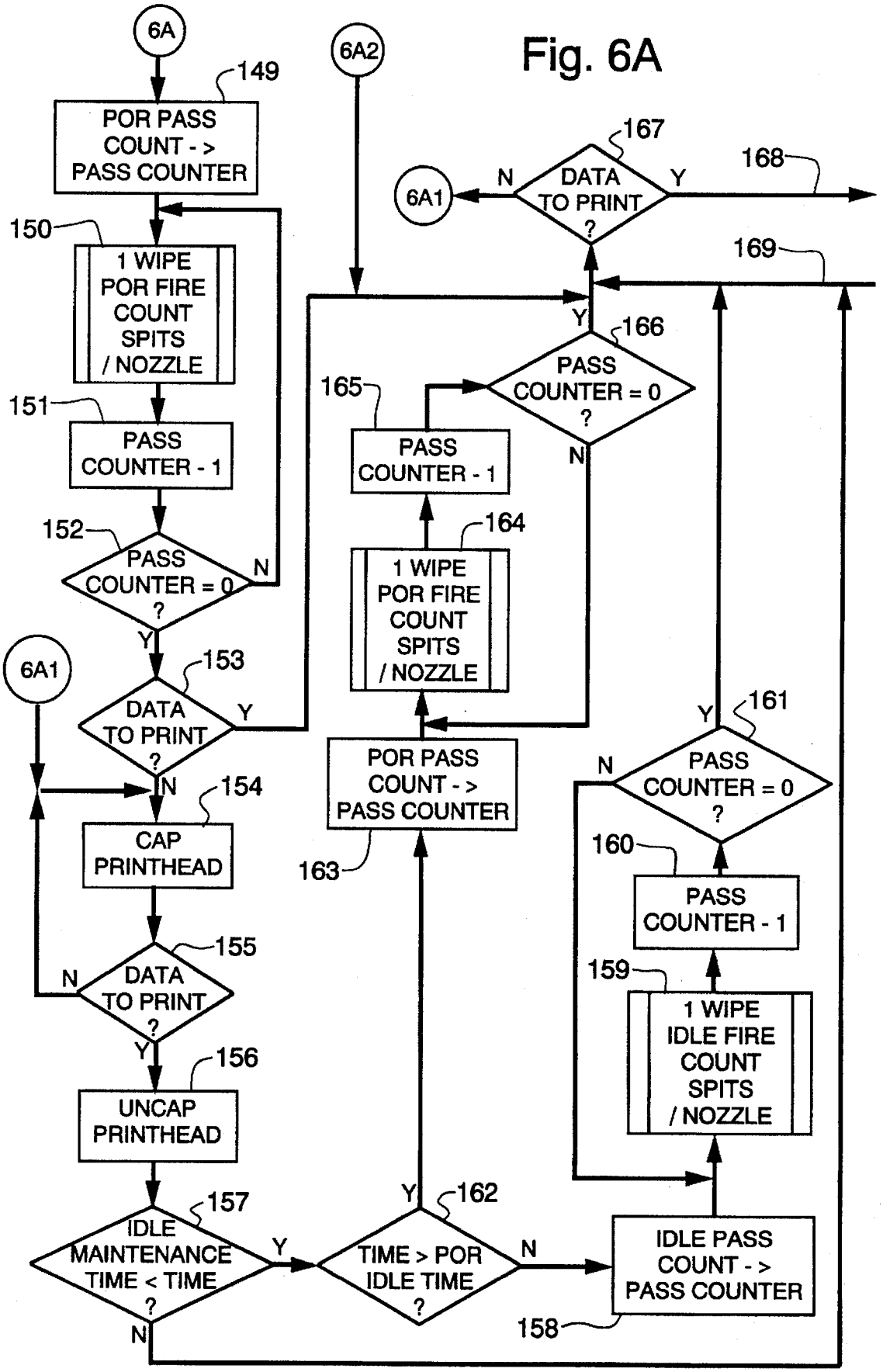
Fig. 6A
6A
149
POR PASS COUNT -> PASS COUNTER
150
1 WIPE POR FIRE COUNT SPITS / NOZZLE
151
PASS COUNTER - 1
152
PASS COUNTER = 0 ?
N
Y
6A1
153
DATA TO PRINT ?
Y
N
154
CAP PRINTHEAD
155
DATA TO PRINT ?
N
Y
156
UNCAP PRINTHEAD
157
IDLE MAINTENANCE TIME < TIME ?
Y
N
6A2
Y
162
TIME > POR IDLE TIME ?
N
163
POR PASS COUNT -> PASS COUNTER
164
1 WIPE POR FIRE COUNT SPITS / NOZZLE
165
PASS COUNTER - 1
166
PASS COUNTER = 0 ?
Y
N
167
DATA TO PRINT ?
N
Y
6A1
168
169
161
PASS COUNTER = 0 ?
Y
N
160
PASS COUNTER - 1
159
1 WIPE IDLE FIRE COUNT SPITS / NOZZLE
IDLE PASS COUNT -> PASS COUNTER
158

168
169
170
FIRE COUNT > FIRE THRESHOLD FIRES / COLOR ?
Y
N
1 WIPE IDLE FIRE COUNT FIRES / NOZZLE
172
171
> 18 SEC. SINCE LAST PRINT ?
Y
N
1 WIPE
173
END OF PAGE ?
N
Y
174
179
8 SPITS / NOZZLE
N
PAGE COUNT = PAGE THRESHOLD ?
175
Y
1 WIPE POR FIRE COUNT SPITS / NOZZLE
176
180
1 WIPE
Y
END OF JOB ?
177
N
181
1 WIPE
Y
OUT OF PAPER ?
178
N

PROGRAMMABLE HEAD TYPE DETECTION AND MAINTENANCE SYSTEM

RELATED APPLICATIONS

This application is a continuation-in-part of the copending application of Hassan Bahrami et al. Ser. No. 08/327,935 filed Oct. 24, 1994 and assigned to the same assignee as this application.

FIELD OF THE INVENTION

The present invention relates to ink-jet printers for multicolor or monochrome printing. More particularly, the present invention provides a control system for maintaining the printhead of an ink-jet printer, the system being easily programmed and reprogrammed to accommodate newly developed printheads so that optimum printhead maintenance may be achieved even though printheads having different nozzle geometries or heater designs, or using different ink formulations may be used in the printer.

BACKGROUND OF THE INVENTION

Maintenance of an ink-jet printhead is a combination of a specific number of nozzle fires (spits) to clear the nozzles of debris and drying or dried ink, wiping the nozzle plate to remove ink and debris (wipes), and sealing the environment around the nozzles (capping) to prevent ink from drying in the nozzles during periods of non-use. Operations of the printer to maintain the printhead nozzles is highly dependent on the design of the printhead. Such factors as nozzle geometry, heater design and the formulation of the ink all affect the frequency at which wiping must be done, the number of wipes, the number of spits and the intervals at which spits must take place, and the duration of each spit, in order to obtain optimum maintenance.

In order to use a new printhead design in an already existing printer, the maintenance design or algorithm may require modification to adequately maintain the new printhead. In the past, improved printheads might not be incorporated into existing printers if the maintenance requirements of the new printheads were too different from the requirements of the printheads for which the maintenance program was designed. Alternatively, a printer incorporating an appropriate maintenance algorithm was designed for use with printheads of the new design.

PRIOR ART

It is known to provide a color ink-jet printer with a controller for executing two maintenance algorithms, one for maintaining a color printhead and one for maintaining a monochrome printhead. However, the maintenance algorithms of these printers are designed for one specific species of color printhead and one specific species of monochrome printhead, the maintenance requirements of which are known at the time the maintenance algorithms are designed. These printers are not capable of optimally maintaining plural types species of color printheads or plural types species of monochrome printheads. No provision is made for obtaining optimum maintenance if, for example, a subsequently developed printhead having different maintenance requirements is later installed in the printer.

It is also known to provide printheads with sense lines which may be left open-circuited or connected to thereby distinguish between color and monochrome printheads. U.S. Pat. No. 5,155,497 discloses such a system. However, this system is capable of distinguishing between printheads of only two types, color and monochrome, and is not capable of distinguishing between different species of color printheads and different species of monochrome printheads.

BRIEF DESCRIPTION OF THE INVENTION

An object of the present invention is to provide a maintenance system for ink-jet printheads, the system being capable of maintaining various species of either color type or monochrome type printheads.

A further object of the invention is to provide a printhead maintenance system which may be easily re-programmed so as to properly maintain printheads of species other than a species for which the system was originally designed.

Another object of the invention is to provide a printhead maintenance system including a programmable controller for executing a basic maintenance algorithm and means for modifying the basic maintenance algorithm to provide optimum maintenance for printheads having maintenance requirements that are not known at the time the basic maintenance algorithm is designed.

Still another object of the invention is to provide a controller for executing a maintenance algorithm, encoding means on a printhead to identify the species of printhead, means for sensing the encoding means, a memory for storing a plurality of descriptor records each record including a plurality of maintenance parameters and a detection pattern identifying a species of printhead, and means responsive to the sensing means and the detection patterns in the descriptor records for selecting the maintenance parameters in one of the descriptor records for use in the maintenance algorithm.

In a preferred embodiment of the invention, each printhead carries an encoding means identifying its species. The encoding means comprises the pattern of connections of the nozzle heaters to tab circuit terminals on the printhead and defines the species of printhead. Dummy heaters are provided to distinguish between different species of printheads. A programmable and reprogrammable ($E^2$PROM) memory is provided for storing descriptor records. A descriptor record is provided for each species of printhead and before a printhead of a new (i.e. never before used) species is installed in the printer, a descriptor record for the new species of printhead is downloaded to the memory from the data processor or computer to which the printer is connected. Each descriptor record includes a detection pattern and various parameters specifying such things as the number of wipes and spits, when wiping and/or spitting should occur, etc. When power is turned on, or after a printhead is installed, a controller senses the pattern of heaters on the installed printhead, compares the sensed pattern with the detection patterns in descriptor records to find a best match, and when a best match is found the parameters in the descriptor record are read out of the memory to fixed locations. The controller executes a maintenance program that includes a first algorithm for color printheads and a second algorithm for monochrome printheads. The algorithms access the maintenance parameters that have been transferred from the memory to the fixed locations so as to control the timing and number of wipes and/or spits necessary for optimum maintenance of the installed printhead.

Other objects and advantages of the invention and the manner of implementing and using it will become obvious from consideration of the following description and the accompanying drawings.

BRIEF DESCRIPTION OF DRAWINGS

FIGS. 4, 5, 6A and 6B comprise a flow diagram of a program executed by a controller of the maintenance system to maintain printheads of various types;

DESCRIPTION OF PREFERRED EMBODIMENT

Figure 1:
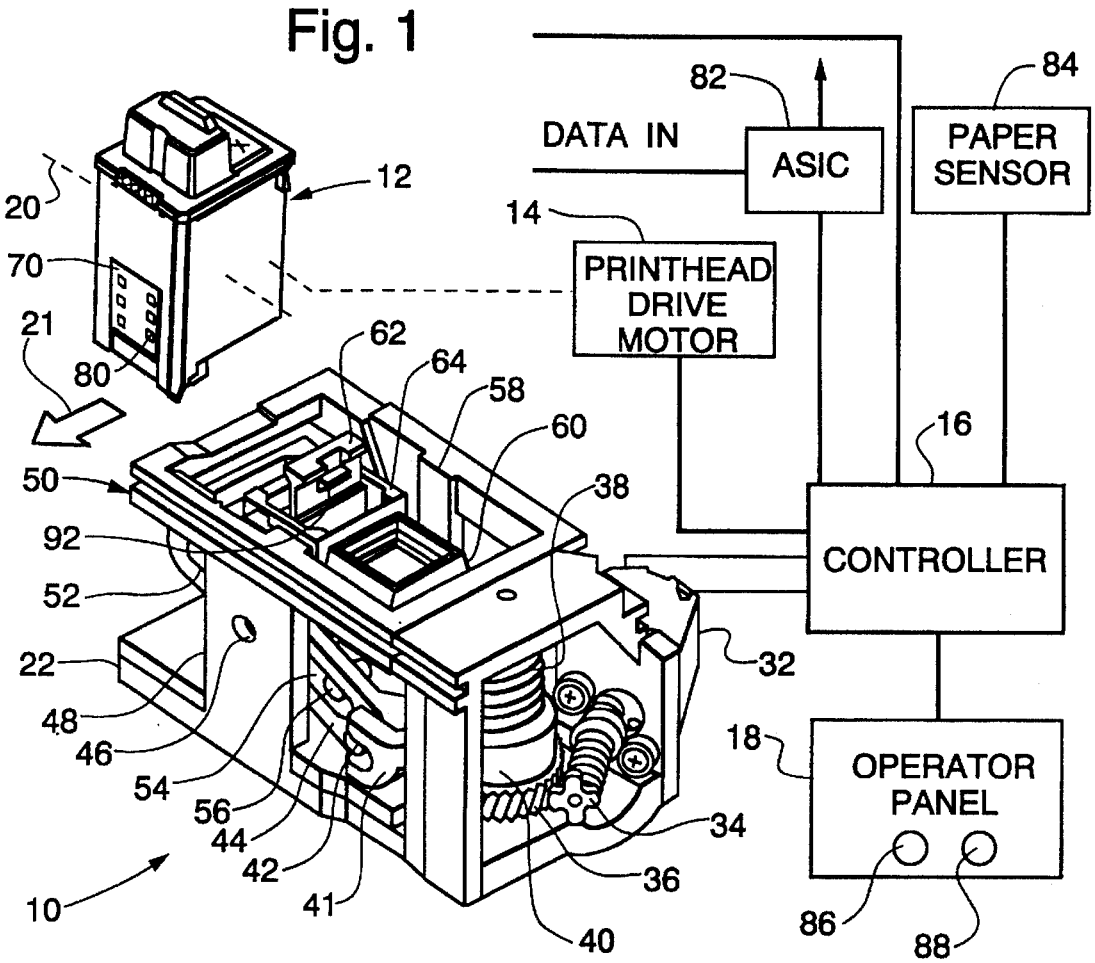
FIG. 1 schematically illustrates a printhead and a maintenance system for a printhead.

As shown in FIG. 1, a printhead maintenance system comprises a maintenance station 10 for maintaining a printhead 12, a printhead drive motor 14, a controller 16, and an operator control panel 18. A maintenance system of the type shown in FIG. 1 is disclosed in the above-referenced application, the disclosure of which is incorporated herein by reference.

The printhead drive motor 14 moves the printhead 12 back and forth along an axis 20 above the plane of a record feed path, indicated by the arrow 21. The maintenance station 10 includes a bi-directional drive motor 32 driving a worm gear 34 that meshes with a gear 36. A drive screw 38 is mounted on the same shaft as gear 36 and carries a drive nut 40. Depending on the direction of energization of motor 32, worm gear 34 is driven in one direction or the other so as to rotate drive screw 38. Depending on the direction of movement of drive screw 38 the drive nut 40 moves upwardly or downwardly.

Drive nut 40 has two forked arms 41 extending outwardly therefrom, only one of the arms 41 being visible in FIG. 1. The forked arms engage two projections 42 provided on opposite sides of a rocker frame 44. The frame 44 is pivotally supported by pivots extending into holes 46 in the sides 48 of the maintenance station frame 50 so that as the drive nut 40 is moved up or down the rocker frame 44 pivots about the axes of holes 46 in a seesaw like manner.

Rocker frame 44 has two slots 52 and 54 on one side and two similar slots on the side not visible in FIG. 1. An elastomeric cup-like cap 60 is mounted on a support having two projections 56 extending into the slots 54. The support is slidably mounted for vertical movement on a post (not shown) extending upwardly from the base 22 of the maintenance station frame.

A wiper 62 is mounted on the bottom of a spit cup 64 and the spit cup is mounted on a support (not shown) having projections extending into slots 52. The arrangement is such that as the rocker frame 44 tilts clockwise as viewed in FIG. 1, the cup 60 is lowered and the wiper 62 is raised, and as the rocker frame 44 tilts counter-clockwise the cup is raised as the wiper is lowered.

Figure 2:
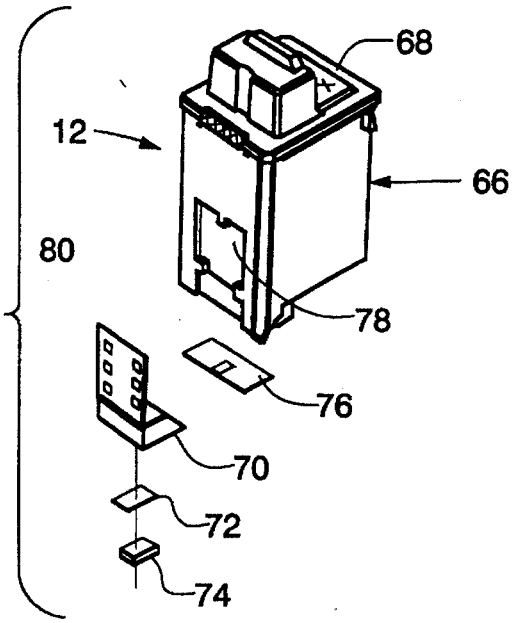
FIG. 2 is an exploded perspective view of a printhead.

In FIG. 2, a typical printhead 12 comprises a cartridge body 66 having a non-removable cap 68, a tab circuit 70, a heater chip 72, a nozzle plate 74 and two adhesive preforms 76, 78 for adhesively attaching the tab circuit to the bottom and front of the cartridge body. The printhead 12 is conventional in that the body 66 has either one ink reservoir for holding a supply of black ink or three reservoirs for holding supplies of inks of three different colors. The ink reservoir(s) is/are connected via ducts (not shown) to nozzles in the nozzle plate 74. The number and arrangement of the nozzles may vary. For purposes of the following description, and by way of illustration only, a monochrome printhead may comprise 56 nozzles arranged in two columns and a color head may comprise 48 nozzles divided into three groups, each group comprising two columns of nozzles with 8 nozzles in each column.

The heater chip 72 includes a plurality of heaters, one heater for each nozzle. The heaters are individually connected by circuitry (not shown) to tabs 80 on tab circuit 70. In accordance with one aspect of the present invention one or more dummy heaters is/are provided in heater chip 72 and connected to tabs 80 to provide a heater position pattern or code which uniquely identifies a given printhead as being of a certain species.

Figure 3:
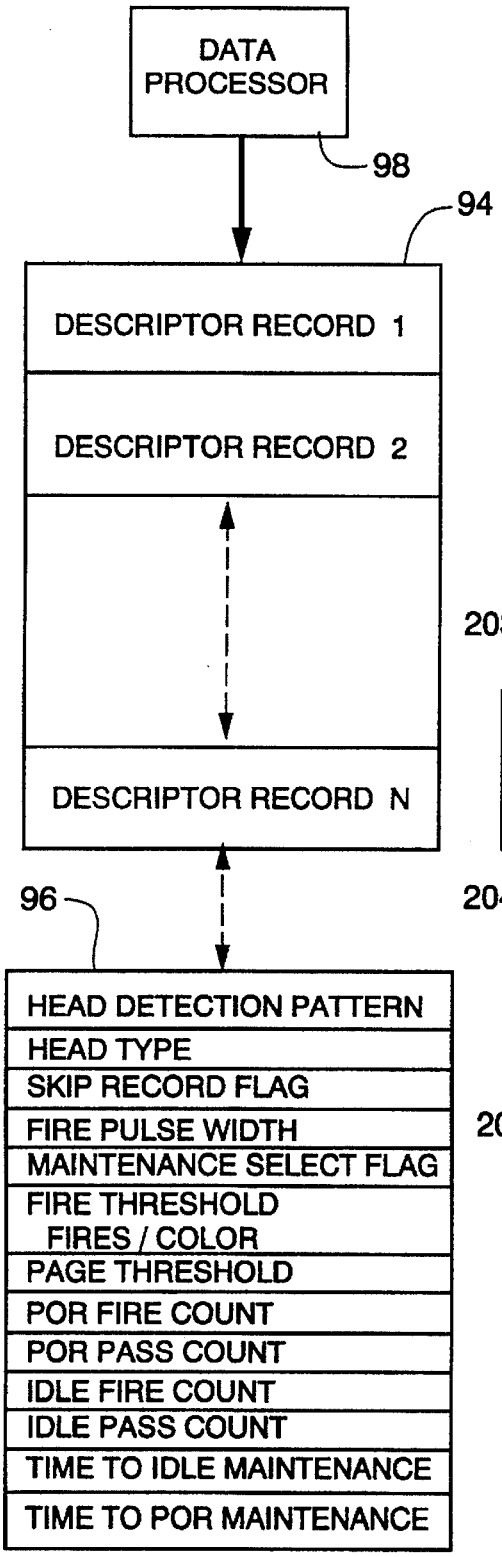
FIG. 3 illustrates downloading of descriptor records from a computer to the printer memory, and the information content of a descriptor record.

Printing takes place in a conventional manner. As a record sheet is fed under printhead 12 in the direction of arrow 21, the printhead is moved back and forth over the record sheet by printhead drive motor 14 as the heaters are selectively energized so that ink within the printhead is ejected from the nozzles. Data to be printed is received by an Application Specific Integrated Circuit (ASIC) 82 (FIG. 1) from a data processor or computer 98 (FIG. 3). The ASIC 82 converts or reformats the data and sends electrical signals to the nozzle heaters 72 via tabs 80 to control ejection of ink from the nozzles.

The maintenance station 10 and the printhead 12 are disposed on opposite sides of the plane 21 in which a record is fed past the printhead with the top surface 58 of the maintenance station frame being just slightly below, and preferably to one side of the record feed path. The motor 32 moves the rocker element 44 between three operative positions: a wiper active position where the wiper 62 extends about 0.5 mm above the path traversed by the nozzle plate 74 so that the wiper is bent over and wipes the nozzle surface as the printhead is moved past the wiper by printhead drive motor 14; a cap active position where the cap 60 presses against the nozzle surface when the printhead is positioned over the cap to form a closed environment around the nozzles; and an inactive position where the cap and wiper are withdrawn from the printhead below the top surface 58 of the maintenance station.

The wiper 62 has a first wiping edge 90 on one side for wiping monochrome printheads and the opposite side of the wiper is provided with three wiping edges 92 for wiping the three groups of nozzles on a color printhead.

FIG. 1 shows the wiper 62 mounted in the maintenance station with an orientation that places the wiping edge 90 on the inboard or left side of the wiper and the wiping edges 92 on the outboard or right side. To wipe a monochrome printhead, controller 16 energizes the printhead drive motor 14 to move the printhead to a position to the left of wiper 62. The controller 16 then energizes the maintenance station drive motor 32 in a direction which causes the wiper 62 to be driven upwardly until it extends into the path of travel of the nozzle surface. The controller then energizes the printhead drive motor 14 to drive the printhead to the right. As the printhead moves past the wiper it deflects the wiper and wiping edge 90 wipes the nozzle surface. When the wiping edge 90 has wiped the nozzles, the controller 16 stops the printhead carriage drive motor. This completes one wipe of the monochrome printhead. Experience has shown that normally a single wipe is sufficient to clean a monochrome printhead. After the wipe is completed, the wiper is lowered and the printhead is moved over the spit cup. The controller then applies signals to the printhead to cause each nozzle to fire a number of times to clear the nozzles of any debris, including dried link that may have accumulated in them. As subsequently explained the action of the maintenance station after the nozzles have been fired varies according to the status of the printer. If there is no data to be printed, controller 16 energizes motors 14 and 32 to move the printhead over cap 60 and raise the cap. If there is data to be printed the controller 16 energizes motor 32 to lower the wiper to the mid-position where the wiper and cap are both out of contact with the printhead.

To wipe a multi-color printhead, controller 16 energizes the printhead drive motor 14 to move the printhead to the right of the wiper 62 as viewed in FIG. 1. Next, controller 16 energizes motor 32 to raise the wiper into the path of travel of the nozzle plate. The printhead drive motor 14 is then energized to move the printhead to the left. As the printhead moves to the left, it deflects the wiper so that wiping edges 92 wipe the nozzles. The printhead movement is stopped as soon as the wiping edges 92 have wiped past the nozzles. The wiper is then lowered and the printhead is moved so that the nozzles are over the spit cup 64. After a wipe of a multi-color printhead, the controller 16 may or may not apply signals to the printhead to fire each nozzle a number of times to clear the nozzles.

As will be evident from the description provided below, the present invention may find use in printers having two separate maintenance stations, one for monochrome and one for color printheads, with a separate wiper being provided for each station. Obviously, in a maintenance system of this type movements of the capping and wiping means, and the positioning and movement of the printhead by the printhead drive motor will differ from those described above. Therefore, in the description of the maintenance program which follows, details as to the positioning and movement of the printhead, wiper and cap to accomplish wiping and capping are omitted.

The controller 16 is located within the printer cabinet and may be a microcomputer including A/D conversion and RAM, ROM and $E^2$PROM memories. The ROM stores a program of instructions comprising two maintenance algorithms. One maintenance algorithm is provided for maintaining type printheads and a second maintenance algorithm is provided for maintaining monochrome type printheads.

The $E^2$PROM memory 94 is illustrated in FIG. 3. It stores a plurality of head descriptor records 96 which are downloaded to the memory from the data processor or computer 98. Each descriptor record 96 includes a Head Detection Pattern which is a pattern of bits, each bit of the pattern corresponding to one of the terminal positions 80 on the tab circuit 70. Each species of printhead is identified by which terminals 80 have heaters, including dummy or encoding heaters, attached thereto.

Initially, memory 94 is loaded with one descriptor record for each species of printhead it is known will be used in the printer. Subsequently, if a new species of printhead is developed, that is a printhead having ink, heaters, nozzles, etc. with different characteristics, the new species printhead is provided with one or more dummy heaters attached to its terminals 80 to thereby uniquely identify the printhead species. Before the new species printhead is installed in the printer, memory 94 is reprogrammed by downloading a new descriptor record from data processor 98, the new descriptor record having a Head Detection Pattern corresponding to the pattern in which heaters and dummy heaters are connected to terminals 80 of the new species printhead. As subsequently explained with reference to FIG. 4, the controller 16 senses the terminals 80 and compares the sensed pattern with the Head Detection Pattern in each descriptor 96 to determine which species of head is installed in the printer.

In addition to the Head Detection Pattern, each descriptor record includes a Head Type, a Skip Record Flag and a Fire Pulse Width. Head Type is a word broadly defining a printhead as a color type or a monochrome type printhead. The Skip Record Flag provides a means for skipping records during comparison of a sensed head detection pattern with the Head Detection Patterns in the descriptor records. This flag may be set, for example, to cause bypassing of a descriptor record in the event that modifications are required to the maintenance algorithm associated with the head detection pattern. The Fire Pulse width is a value representing the duration of current pulses which should be applied to the heaters 72 to cause ink to be ejected from the printhead nozzles during normal printing and when spitting for maintenance purposes.

The descriptor records also include a plurality of parameters or numeric values used by controller 16 in executing the maintenance program. These parameters are:

POR PASS COUNT: When the printer is turned on, maintenance is performed on the printhead by wiping it to remove debris accumulated thereon while the printer was off. The POR Pass Count defines the number of times the printhead is wiped at power-on-reset (POR).

POR FIRE COUNT: Defines the number of times each nozzle is fired after each wipe defined by the POR Pass Count.

TIME TO IDLE MAINTENANCE: After a printer is turned on, it may stand idle with the printhead capped for some period of time with nothing to print. If the time period exceeds some fixed interval, specified by Time To Idle Maintenance, then idle maintenance is performed immediately prior to the next printing of data.

IDLE PASS COUNT: Defines the number of printhead wipes which take place during the idle maintenance.

IDLE FIRE COUNT: Defines the number of times each nozzle is fired after each wipe during idle maintenance.

TIME TO POR MAINTENANCE: Some color printheads require extra maintenance, over and above the idle maintenance, after extended idle periods during which no printing takes place. The parameter Time To POR Maintenance defines a time interval greater than that defined by Time To Idle Maintenance. If the printer remains idle for an interval greater than that specified by Time To POR Maintenance then the printhead is maintained in the same manner as when power is turned on. The printhead is wiped for the number of times specified by POR Pass Count, and after each wipe the nozzles are each fired the number of times specified by POR Fire Count. This parameter is not used in maintaining monochrome printheads.

PAGE THRESHOLD TO MAINTENANCE: This parameter defines the number of pages passing through the printer after which maintenance, comprising one wipe followed by POR Fire Count spits per nozzle, is performed.

FIRE THRESHOLD Fires/Color: This parameter comprises three values, one for each color of ink in a color printhead. The different inks may have different characteristics hence the nozzles ejecting ink of one color may require more frequent spitting than nozzles ejecting another color ink. All nozzles ejecting ink of a particular color are not necessarily fired each firing cycle during normal printing.

The controller 16 includes three counters, one for each color group of nozzles. Each time any nozzle in a color group is fired, the counter for that color group is incremented and compared to the corresponding color value in Fire Threshold Fires/Color. When the two values are equal, the printhead is wiped one time and all nozzles are fired a number of times as specified by Idle Fire Count. This insures that all nozzles of a color group get fired.

MAINTENANCE SELECT FLAG: Is an optional flag which may be used in cases where there is limited space available in the memory which stores the descriptor records. If there is only limited $E^2$PROM memory space available, plural sets of values for Fire Threshold Fires/Color may be stored in a separate memory and the Maintenance Select Flag used to select one of the sets. Thus, a descriptor record, as downloaded from the computer 98, may have a Maintenance Select Flag or, alternatively, it may have Fire Threshold Fires/Color therein.

FIGS. 4, 5, 6A and 6B illustrate the steps of a maintenance program executed by controller 16 to maintain the printhead 12. The program comprises a first algorithm, shown in FIG. 5 for maintaining monochrome printheads and a second algorithm, illustrated in FIGS. 6A and 6B for maintaining color printheads. In addition, the program includes a portion (FIG. 4) which is common to both algorithms.

Figure 4:
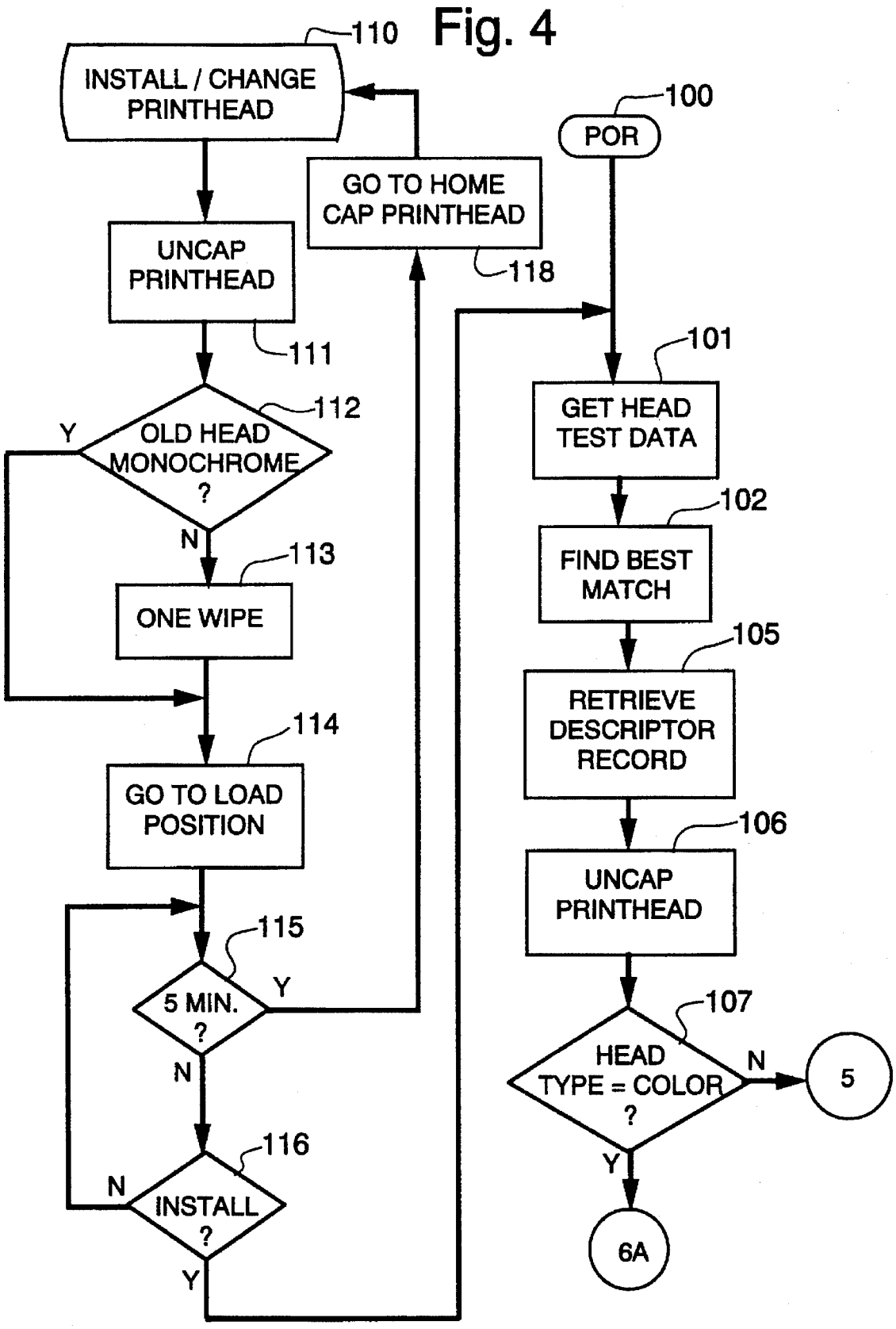

Assume that the power to the printer is off, the descriptor records have been downloaded to the printer $E^2$PROM memory 94, and the printhead 12 is over cap 60 with the cap in the raised position to provide a closed environment around the printhead nozzles. In FIG. 4, when the power switch on the printer is turned on the controller 16 executes a power up reset (step 100) during which it resets various counters, registers and flags. The controller next gets the head test data (step 101) by applying sense currents to each of terminals 80 and sensing the voltage drops. The controller builds up a sense word of 1 and 0 bits depending on whether a voltage drop is or is not sensed.

The controller then searches the descriptor records in memory 94 to find the best match between the sense word and the Head Detection Pattern words in the descriptor records. The Skip Record Flag in a descriptor record is first checked and if the flag is set, the Head Detection Pattern in that descriptor record is not compared to the sense word. If the Skip Record Flag is not set, the Head Detection Pattern is compared with the sense word and a match word is developed before the Skip Record Flag of the next descriptor record is checked. This is repeated until the Head Detection Pattern of each descriptor record has been compared to the sense word. At step 102 the controller determines from the match words the descriptor record having the Head Detection Pattern which best matches (normally equal to) the sense word. That descriptor word is then retrieved (step 105).

Retrieval of the descriptor record is accomplished by transferring to specific locations the Head Type, Fire Pulse Width, Page Threshold, POR Fire Count, POR Pass Count, Idle Fire Count, Idle Pass Count, Time To Idle Maintenance and Time To POR Maintenance. If the Fire Threshold Fires/Color parameter has been downloaded to memory 94 as discussed above, the values therein are also read out to specific locations. If the Maintenance Select Flag was downloaded to $E^2$PROM memory 94, it is read out and used to access one set of Fire Threshold Fires/Color values which are transferred to specific locations. The specific locations to which the parameters of the descriptor record are transferred are hence-forth identified by the parameters they contain.

After the descriptor record has been retrieved, controller 16 sends a signal to maintenance station drive motor 32 to move the cap 60 and wiper 62 to the inactive position thereby uncapping the printhead 12 (step 106). Step 107 then tests location Head Type to determine if the installed printhead is a color type or a monochrome type. If the printhead is a color printhead the program advances to the color printhead maintenance algorithm (FIG. 6A) but if the printhead is a monochrome printhead the program advances to step 119 (FIG. 5) to begin the monochrome printhead maintenance algorithm.

At step 119, a Pass Counter is loaded with the value in location POR Pass Count.

Figure 7:
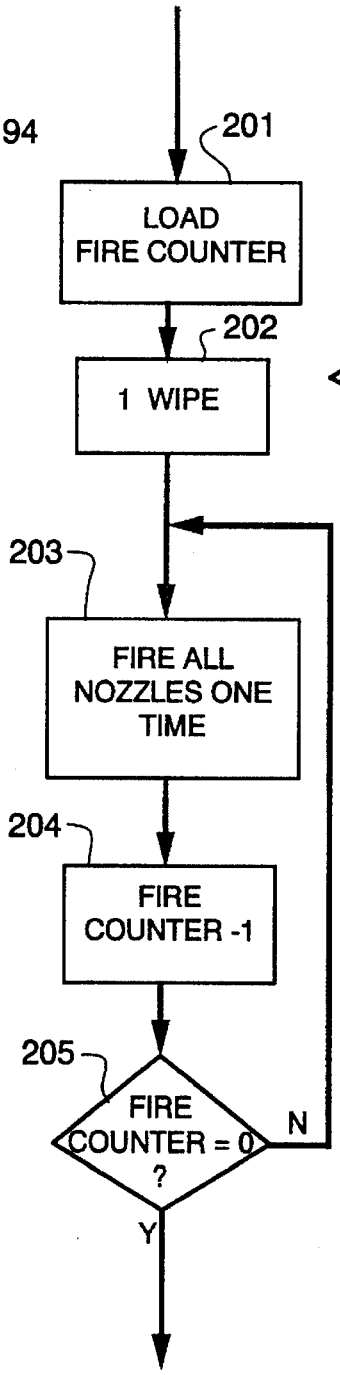
FIG. 7 illustrates a wipe and fire sub-routine executed by the controller.

At step 120, a subroutine is executed to wipe the monochrome printhead one time and fire all nozzles a number of times equal to the value in location POR Fire Count. FIG. 7 illustrates the subroutine executed at step 120. Step 201 loads a Fire Counter with the contents of location POR Fire Count. Printhead drive motor 14 and maintenance station drive motor 32 are then energized (step 202) to wipe the printhead one time. The controller then sends signals to the printhead (step 203) to energize all the heaters thereby firing each nozzle one time. After the nozzles are fired, the count in the Fire Counter is decremented by one (step 204) and tested for a zero value (step 205).

If step 205 determines that the value in Fire Counter is not zero, the program loops back to step 203 and the controller again fires each nozzle one time. The loop comprising steps 203–205 is repeated until the test at step 205 determines that Fire Counter has been decremented to zero. The controller then returns to FIG. 5 where the Pass Counter is decremented (step 121) and tested (step 122) to determine if it contains a zero value.

If step 122 determines that Pass Counter has not been decremented to zero, the program loops back to step 120, or, more specifically, to step 201 in FIG. 7. The value in location POR Fire Count is again loaded into the Fire Counter and steps 201–205, 121 and 122 are repeated as described above. This continues until the test at step 122 determines that the value in Pass Counter has been reduced to zero. Therefore, steps 120–122 cause the printhead 12 to be wiped a number of times as specified by the POR Pass Count with all nozzles being fired, after each wipe, the number of times specified by the POR Fire Count.

Although not shown in the drawing for the sake of clarity, the controller 16 includes a timer (TLP) which is reset each time any nozzle is fired, either for printing or maintenance spitting purposes. TLP times the elapsed interval since the last "printing". TLP is reset each time the nozzles are fired during execution of step 120.

When step 122 determines that the Pass Counter has been decremented to zero, the controller advances to step 124 where an indicator is tested to determine if the ASIC 82 holds data ready for printing. If the test at step 124 proves true, the program advances to step 130. However, if the test at step 124 proves false the program advances to step 125 where printhead drive motor 14 is energized to move the printhead over cap 60, and motor 32 is energized to raise cap 60 to cap the printhead.

After the printhead is capped, the controller begins sensing the ASIC 82 (step 126) to determine if there is data to print. The printhead remains capped and the controller continues to sense the ASIC until the ASIC sets an indicator indicating that data is ready to print. When data is ready to print, TLP is compared (step 128) with the value in location Time To Idle Maintenance to determine if the interval of time since the nozzles were last fired is greater than the time specified by the value in location Time To Idle Maintenance. If the comparison at step 128 determines that the printer has not been idle for a period longer than that specified by Time To Idle Maintenance, the controller enables the ASIC so that data in the ASIC may be transferred to the printhead nozzle heaters to print the data. On the other hand, if step 128 determines that the printer has been idle for an interval greater than that specified by Time To Idle Maintenance, step 129 is executed to wipe the printhead one time and fire each nozzle a number of times specified by the value in location Idle Fire Count.

Step 129 comprises a subroutine of steps similar to steps 201–205 (FIG. 7) previously described except that the FIRE Counter is loaded with the value from location Idle Fire Count.

Controller 16 continues to monitor the data ready indicator in the ASIC (step 130) after the ASIC is enabled. When there is data to print, step 131 determines if more than some threshold time, say 50 seconds, is required to print a page. A paper sensor 84 (FIG. 1) sets an indicator bit and enables a timer (TIP) in controller 16 when it senses the leading edge of a sheet of paper in the record feed path, and resets the bit and stops the timer when it senses the trailing edge. At step 131 TIP is sensed to determine if more than 50 seconds has elapsed since the start of a page. If 50 seconds has elapsed, the ASIC output to the printhead is disabled and controller 16 energizes the printhead drive motor 14 to move the printhead over the spit cup 64. The controller then fires each nozzle 8 times (step 132). After the nozzles are fired, the controller again enables the output of the ASIC and returns to step 130. Since a specific printing application may not require firing of all nozzles within a 50 sec interval, steps 131 and 132 are provided to ensure that all nozzles are fired, thus preventing ink from drying in the nozzles.

If step 131 determines that 50 sec has not elapsed since the start of the page, the paper sensor indicator bit is tested at step 133 to determine if the end of a page has been reached. If the end of the page has not been reached the controller 16 continues to monitor the data ready indicator in the ASIC (step 130) and the ASIC outputs data to the printhead.

The loop represented by steps 130–133 is repeatedly executed until (1) 50 sec has elapsed as described above, (2) the end of page has been reached, or (3) there is no data in the ASIC to print. If step 133 detects an end of page, a page counter is incremented and compared at step 134 with the value in location Page Threshold. If the count in the page counter is not equal to the value in location Page Threshold, step 135 is executed. The printhead is moved over the spit cup 64 and signals are sent to the printhead to fire each nozzle 8 times. On the other hand, if the count in the page counter is equal to the value in location Page Threshold, the page counter is reset, the ASIC is prevented from sending data to the printhead, and a wipe followed by firings of each nozzle is carried out (step 136) before the routine returns to step 130. Step 136 comprises a subroutine of steps like steps 201–205, with the Fire Counter being loaded with the value in location POR Fire Count to control the number of firings of each nozzle after the wipe has been completed.

Controller 16 includes a timer (NDP) for tolling intervals of time in which the ASIC holds no data ready for printing. NDP is reset each time step 130 is executed if the ASIC holds data for printing. If there is no data to print, step 137 is executed to determine if the timer NDP has tolled an 18 sec interval. If less than 18 sec has elapsed since the ASIC last held data to print, the controller 16 repeatedly executes the loop including steps 130 and 137. If the ASIC should develop data ready to print during the 18 sec interval, this is detected at step 130 and the routine again branches to step 131.

If 18 sec should elapse during which time the ASIC holds no data for printing, the test of NDP at step 137 will prove true and the routine will advance to step 125 to cap the printhead by first energizing motor 14 to move the printhead over cap 60 and then energizing the motor 32 to raise the cap into contact with the printhead. Controller 16 then begin monitoring the ASIC (step 126) for an indication that the ASIC has data ready for printing. As long as the ASIC has no data to print, the printhead remains capped (step 125) and the controller monitors the ASIC.

Figure 6B:
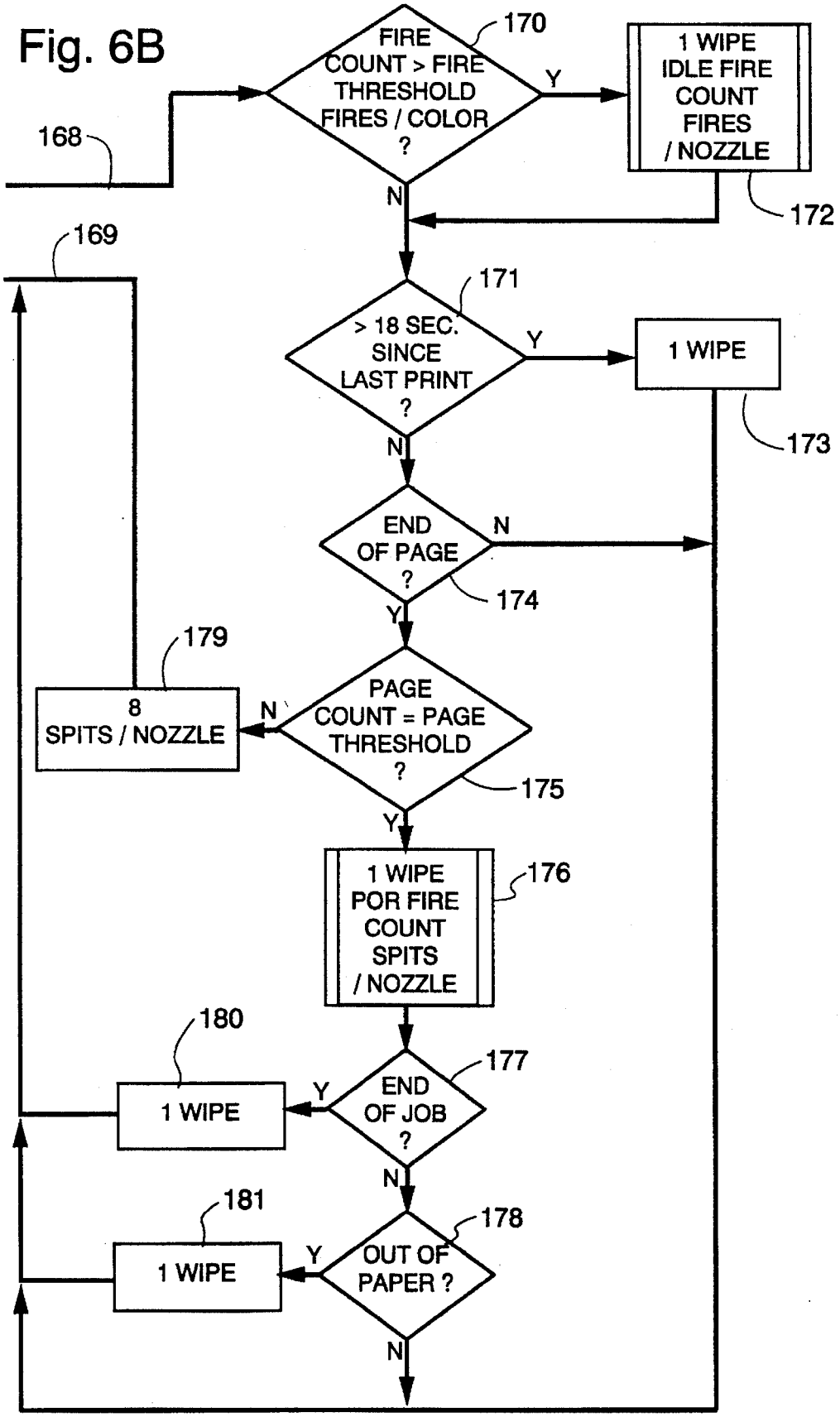

FIGS. 6A and 6B show the maintenance algorithm for maintaining a multi-color printhead. When printer power is first turned on, the controller 16 executes steps 100–102 and 105–107 as described with reference to FIG. 4 to determine which type species of printhead is installed in the printer, retrieve the descriptor record for that type of head, and uncap the printhead. When step 107 determines that the printhead is one of the color type printheads, the controller advances to step 149 where the Pass Counter is loaded with the value in POR Pass Count. At step 150 the subroutine of FIG. 7 is executed to wipe the nozzle one time and fire each nozzle a number of times specified by the value in location POR Fire Count.

After one wipe and the specified number of nozzle firings, the Pass Counter is decremented (step 151) and tested for a zero value (step 152). If the Pass Counter contains a non-zero value, the controller returns to step 150 to perform another wipe and fire the nozzles.

When the test at step 152 determines that the Pass Counter has been decremented to zero, controller 16 checks the ASIC data ready indicator (step 153) to determine if there is data to be printed. If there is no data to print, motors 14 and 32 are energized (step 154) to move the printhead over the cap 60 and raise the cap to cap the printhead. After the printhead is capped, the controller 16 continues monitoring the ASIC data ready indicator (step 155), the printhead remaining capped as long as the monitoring detects that no data is ready to be printed.

When step 155 detects that there is data to be printed, the printhead is uncapped (step 156). When the printhead is uncapped, it may require maintenance depending on how long the printer has been idle. Furthermore, different degrees of maintenance may be required depending on the length of the idle period. By way of example, if the printer has been idle for less than one hour then no maintenance is required before printing begins. If the printer has been idle for more than an hour, some maintenance, referred to herein as idle maintenance, is required. If the printer has been idle for an extremely long interval, say eight hours, then a more aggressive maintenance, is necessary. This more aggressive maintenance may be, but does not necessarily have to be the same maintenance performed when the printer power is first turned on.

Step 157 determines if maintenance of some form is required and, if maintenance is required step 162 determines how aggressive the maintenance should be. At step 157 the time-since-last-print counter TLP is compared with the value in location Time To Idle Maintenance to determine if the printer has been idle so long that some degree of maintenance should be performed before printing takes place. If the idle time has not exceeded the Time To Idle Maintenance, the ASIC is enabled so that data may be transferred to the Printhead and the routine advances to step 167. If the idle time exceeds the Time To Idle Maintenance then at step 162 the time-since-last-print counter TLP is compared with the value in POR Idle Time. If the printer idle time does not exceed POR Idle Time then only idle maintenance is required. At step 158 the Pass Counter is loaded with the value in location Idle Pass Count. At step 159 the subroutine (FIG. 7) is executed with the value in location Idle Fire Count being loaded into the Fire Counter. The controller controls motors 14 and 32 to cause one wipe of the printhead, and controls the nozzles to fire each nozzle a number of times as specified by the value in location Idle Fire Count.

After step 159 is completed, the Pass Counter is decremented (step 160) and tested for a zero value (step 161). If the Pass Counter has not been decremented to zero, the controller loops back to step 159 to again wipe the printhead one time and fire each nozzle for the number of times specified by the value in location Idle Fire Count. The loop comprising steps 159–161 is repeated until the Pass Counter has been decremented to zero so that the printhead is wiped the number of times specified by Idle Pass Count.

When step 161 determines that the pass counter has been decremented to zero, the ASIC 82 is enabled so that printing may begin and the routine advances to step 167.

If the test at step 162 shows that the printer has been idle for an interval longer than the interval specified by POR Idle Time, then the routine advances to step 163 where the value in location POR Pass Count is loaded into the Pass Counter to control the number of printhead wipes. The loop comprising steps 164–166 is then executed for the number of times specified by POR Pass Count. Steps 164–166 are like steps 159–161 previously described, the only difference being that each time the subroutine is executed at step 164 the value in location POR Fire Count is loaded into the fire counter at step 201 (FIG. 7) of the subroutine to control the number of firings of the nozzles after each wipe. Step 165 decrements the Pass Counter each time the loop is executed and step 166 tests the Pass Counter for a zero value.

When step 166 detects that the Pass Counter has been decremented to zero, the TLP counter is reset and the controller enables the ASIC so that data may be transferred from the ASIC to the printhead. When the transfer of data from the ASIC is enabled, the controller 16 continues to monitor the data ready indicator in the ASIC (step 167) and if the ASIC holds data ready for printing the cap and wiper are moved to the inactive position.

The controller 16 includes three counters, one for each group of color nozzles. Each time the ASIC sends data to the printhead to fire a nozzle in a particular color group, the counter assigned to that group is incremented. At step 170 the contents of the three counters are compared with respective ones of the three values in location Fire Threshold Fires/Color. If any counter contains a count greater than the Fire Threshold Fires/Color value with which it is compared, the counters are reset, the transfer of data from the ASIC to the printhead is suspended, and step 172 is executed to wipe the printhead one time and fire each nozzle the number of times specified by the value in location Idle Fire Count. This clears any nozzles which may not be fired during a specific application and wipes away any ink which may have accumulated around the nozzles.

If step 170 determines that no counter contains a value greater than the Fire Threshold Fires/Color value with which it is compared, the controller advances directly to step 171. Otherwise, step 172 is executed before the controller advances to step 171.

Step 171 tests the TLP counter to determine if more than 18 sec has elapsed since the last firing of any nozzle. This might occur, for example, in the event of a malfunction or a very complex print job in the processor sending data to the printer. To retard the drying of ink at the nozzles, step 173 is executed to wipe the printhead one time. The routine returns to step 167 and if no data is ready to print motor 32 is energized (step 154) to raise the cap 60 to seal the nozzle environment.

Normally, the test at step 171 should prove false and in this event the indicator bit controlled by paper sensor switch 84 is tested at step 174 to determine if the end of a page has been reached. If not, the program loops back to step 167.

During printing of a single page, the controller repeatedly executes the loop including steps 167, 170, 171 and 174. If the ASIC should run out of data, this is detected at step 167 and the printhead is capped at step 154. If, during the printing of a page the firing of a nozzle or nozzles in one color group should cause the counter for that group to be incremented so that it exceeds the value in Fire Threshold Fires/Color for that group, step 172 is executed to wipe the printhead and fire the nozzles. When the end of a page is reached, an exit is made from the loop at step 174.

At step 175 the contents of a page counter are compared with the value in location Page Threshold. The page counter is incremented by one each time a record passes through the printer to actuate paper sensor switch 84. If step 175 determines that the count in the page counter is not equal to Page Threshold, each nozzle is fired eight times (step 179) and the controller returns to step 167. On the other hand, if step 175 determines that the value in the page counter is equal to Page Threshold, the page counter is reset and step 176 executed to wipe the printhead one time and fire each nozzle the number of times specified by the value in location POR Fire Count.

Next, step 177 is executed to determine if the end of the job has been reached. The end of the job is normally signalled by an end-of-job command from the data processor 98. If the end of job command is received, the printhead is wiped one time at step 180. The routine returns to step 167 and since the end of the job has been reached, that is, there is no more data to print, the routine advances to step 154 to cap the printhead.

Controller 16 includes a timer which is started when the end of a page is detected at step 174. At step 177, if the end-of-job command is not received within a short interval of time, the timer times out and forces the routine to advance to step 178.

Step 178 determines if the printer is out of paper. Controller 16 is provided with a timer which times an interval between the time paper sensor switch 84 opens at the end of one page and the time the switch should be closed by the leading edge of the next succeeding page. At step 178, the controller waits until the timer times out and senses the status of the paper sensor switch. If the paper sensor switch is closed, the controller returns to step 167. On the other hand, if the switch is not closed it is an indication that the paper supply is exhausted. The printhead is wiped one time at step 181. The out-of-paper condition forces the data ready indicator to a false indication that there is no data ready to print. When the maintenance routine loops back to step 167, this false indication causes the routine to branch to step 154 to cap the printhead.

Figure 8:
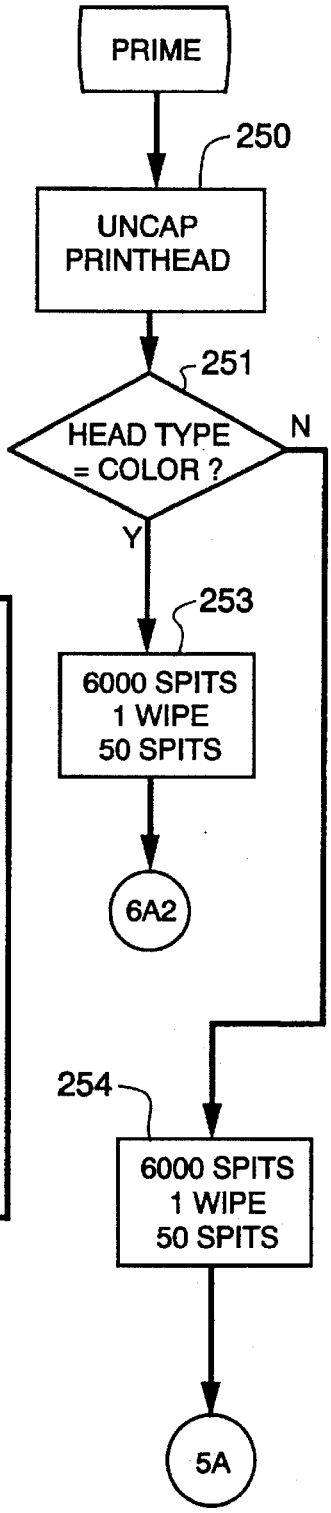
FIG. 8 illustrates steps of the maintenance program executed by the controller in response to actuation of a Prime switch on the printer operator's panel.

Under some conditions such as an abnormally dusty or extremely hot and dry environment, the normal maintenance routine may not adequately maintain a printhead. A Prime push-button switch 86 is provided on the operator's panel 18 to enable the operator to interrupt the normal maintenance routine and initiate a prime operation if the print quality should deteriorate. In FIG. 8 when the operator presses the Prime pushbutton the normal maintenance routine is interrupted and controller 16 advances directly to the prime operation. ASIC transfers of data to the printhead are suspended. The maintenance station drive motor 32 is energized (step 250) to move the wiper and cap to the inactive position if they are not already in the inactive position and the printhead drive motor 14 is energized to move the printhead so that the nozzles are over the spit cup 64. At step 251 the contents of location Head Type are tested to determine if the printhead is a monochrome or a color printhead. If the printhead is a color type printhead, step 253 is executed and if the printhead is a monochrome type printhead step 254 is executed. Steps 253 and 254 accomplish the same functions. That is, the nozzles are all fired 6000 times, the printhead is wiped one 0 time, and the nozzles are all fired 50 9times. The difference between steps 253 and 254 is in the positioning of the printhead prior to wiping and its direction of movement during wiping because a color printhead is wiped with one edge of wiper 62 and a monochrome printhead is wiped with the opposing edge.

When an operator wishes to change printheads, either to replace a printhead with a depleted ink supply with another printhead of the same type or to install a different type of printhead, the operator actuates an Install/Change pushbutton switch 88 on the control panel (step 110, FIG. 4). In response to actuation of the switch, the controller 16 uncaps the printhead (step 111) and determines (step 112) from the value in location Head Type whether the printhead currently in the printer is a monochrome or a multi-color type.

If step 112 determines that the present printhead is monochrome, it does not require wiping before removal and storage. The routine advances to step 114 where the printhead drive motor 14 is energized to move the printhead to a load position. The load position may be at or near the center of the record feed path to give the operator easy access to the printhead. If step 112 determines that the present printhead is a multi-color printhead cartridge, it should be wiped before storage. Step 113 is executed to perform the wipe before the printhead is moved to the load position.

After moving the printhead to the load position the routine tests at step 115 to determine if 5 minutes has elapsed since the operator first actuated the Install/Change switch. Initially, this test proves false and the controller advances to step 116 where a test is made to determine if the Install/Change Switch has been actuated a second time. If the test at step 116 proves false the routine loops back to step 115. The controller thus waits for the operator to depress the Install/Change switch a second time. During this wait the operator may remove the old printhead and install the new printhead. After the new printhead is installed, the operator should actuate the Change/Install Switch 88 again.

If the operator does not actuate the Install/Change switch a second time within 5 minutes of the first actuation, the controller assumes that a printhead is in place and should be capped. At the end of the 5 minute interval the printhead drive motor 14 is energized to move the printhead over cap 60 and motor 32 is energized to raise the cap (step 118).

If the operator actuates the Install/Change switch the second time within the 5-minute interval timed at step 115, the controller advances to step 101 to get the test data for the new head. From step 101 the controller proceeds in exactly the same manner as when the printer is turned on.

From the foregoing description it is seen that the present invention provides a novel maintenance system for controlling maintenance of different species of both multi-color and monochrome printheads with the number of spits and the intervals between wiping/spitting being programmable to accommodate the differing maintenance requirements of printheads having different configurations.

Figure 5:
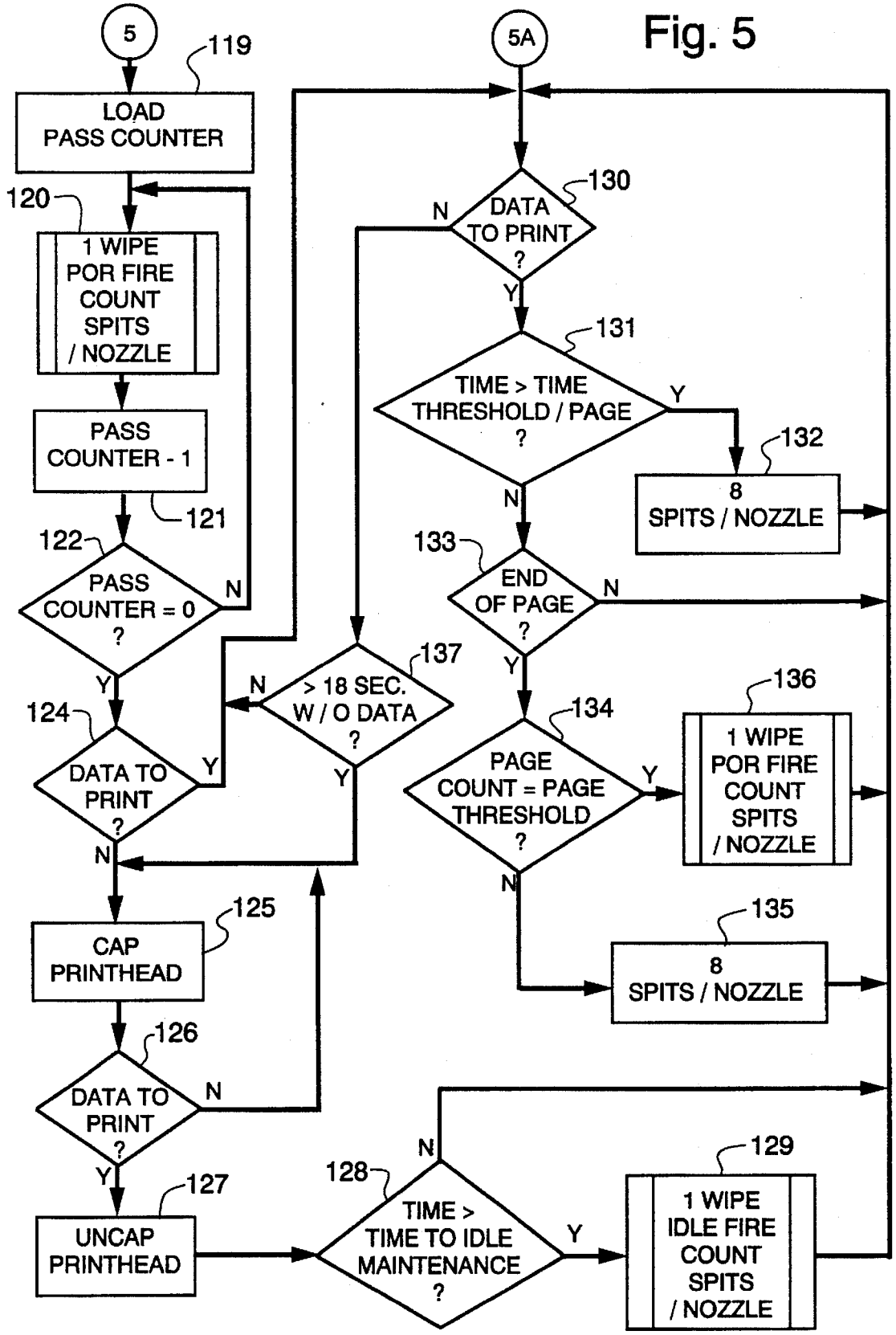

While a preferred embodiment of the invention has been described in detail by way of illustration, it will be understood that various modifications and substitutions may be made in the described embodiment without departing from the spirit and scope of the invention as defined by the appended claims. For example, the 18 sec intervals tested at steps 137 (FIG. 5) and 171 (FIG. 6B) are controlled by values burned into a ROM. If desired, an additional parameter may be added to each descriptor record so that the time intervals may be varied to adapt to yet unknown types of printheads. The same is true of the Time Threshold/Page value employed at step 131 (FIG. 5).

We claim:

1. A maintenance system for maintaining an installed printhead in an ink jet printer capable of printing with a plurality of different species of printheads of a first type, printheads of each species of printheads of said first type having different maintenance requirements from other species of printheads of said first type, said installed printhead including encoding means for identifying it as being of a certain species of said first type, said maintenance system comprising:

a programmable controller including, wiper means for wiping nozzles provided on said printhead; and, control means for executing a maintenance program to cause wiping and firing of said nozzles, said maintenance program including a first algorithm for maintaining an installed printhead of said first type, regardless of the species of the installed printhead, by controlling repetitions of the wiping and firing of said nozzles, a writable non-volatile memory for storing a descriptor record for each species of printhead that may be installed in said printer, each descriptor record including a head detection pattern and parameters for use in said first algorithm; and, selecting means responsive to said encoding means and the head detection patterns in said descriptor records for selecting the parameters in one of said descriptor records for use in said first algorithm whereby the repetitions of the wiping and firing of said nozzles during execution of said first algorithm varies according to the species of said installed printhead of said first type.

2. A maintenance system as claimed in claim 1 wherein said first type of printheads consists of monochrome printheads, said maintenance program including a second algorithm for maintaining color type printheads, each of said descriptor records including a head type parameter, said control means being responsive to a head type parameter selected by said selecting means for executing said first or said second algorithm.

3. A maintenance system as claimed in claim 1 wherein one of said parameters is a value defining the duration of pulses to be applied to said printhead to cause ejection of ink from said nozzles.

4. A maintenance system as claimed in claim 1 wherein said parameters include values defining how many times said nozzles should be wiped and how many times each of said nozzles should be fired after each wipe of the nozzles to maintain an installed printhead.

5. A maintenance system as claimed in claim 4 wherein said control means causes wiping and firing of said nozzles when power to said printer is turned on and said values define how many times the nozzles are wiped and how many times each of the nozzles is fired when power to said printer is turned on.

6. A maintenance system as claimed in claim 1 wherein said parameters include an idle pass count, an idle fire count and a time to idle maintenance, said control means causing wiping of the nozzles a number of times corresponding to said idle pass count and firing of said nozzles a number of times corresponding to said idle fire count before a printing of data takes place if the printer has been idle for at least an interval of time as great as said time to idle maintenance.

7. A maintenance system as claimed in claim 1 wherein said parameters include a page threshold value, said control means being responsive to a page threshold value selected by said selecting means for causing wiping and firing of said nozzles after a number of records corresponding to said page threshold value have been printed by said printer.

8. A maintenance system as claimed in claim 1 wherein said encoding means includes heaters which may be energized to fire said nozzles and dummy heaters all connected to terminals on said printhead, the pattern of connections of heaters and dummy heaters to said terminals defining a printhead as being of a certain species.

9. A maintenance system as claimed in claim 8 wherein said selecting means comprises means for applying sense signals to each of said terminals on the installed printhead to produce a pattern word defining the pattern of connections between said terminals and heaters and dummy heaters, and comparing means for comparing said pattern word with the head detection pattern in each of said descriptor records.

10. A maintenance system as claimed in claim 1 wherein said memory is an $E^2$PROM memory.

11. A maintenance system as claimed in claim 10 and further comprising means external to said printer for loading descriptor records into said memory.

12. A maintenance system for maintaining an installed printhead in an ink jet printer capable of printing with different species of printheads having different maintenance requirements, said installed printhead including encoding means for identifying it as being of a certain species, said maintenance system comprising:

a programmable controller including, wiper means for wiping nozzles provided on said printhead; and, control means for executing a maintenance program to cause wiping and firing of said nozzles, a non-volatile memory for storing a descriptor record for each species of printhead that may be installed in said printer, each descriptor record including a head detection pattern and parameters for use in said maintenance program; and, selecting means responsive to said encoding means and the head detection patterns in said descriptor records for selecting the parameters in one of said descriptor records for use in said maintenance program, said parameters including three values specifying the number of times any nozzle in a color group of a tri-colors species printhead may be fired during a printing of data by said printer before all nozzles of the tri-color species printhead should be fired, said control means including three counters for counting the number of times any nozzle in a respective one of said color groups is fired, and means for causing wiping of the nozzles on said tri-color printhead when one of said counters counts a number of nozzle fires greater than a respective one of said three values.

13. A maintenance system for maintaining a printhead installed in an ink-jet printer capable of selectively printing with different species of printheads having different maintenance requirements, said maintenance system having a controller for executing a maintenance program in accordance with a plurality of parameters to control wiping of nozzles provided on the printhead and firing of said nozzles to eject ink therefrom, said maintenance system being characterized in that said maintenance system includes:

a memory for storing descriptor records, one associated with each species of printhead, each descriptor record including parameters which, when supplied to said controller, cause said controller to execute said maintenance program so as to provide optimum maintenance for the associated species of printhead; and, means for determining the species of printhead installed in said printer and selecting for use by said controller the parameters in the descriptor record which is associated with the species of printhead installed in said printer, said memory being an $E^2$PROM memory whereby additional descriptor records may be loaded therein and said maintenance program executed without change to maintain new species of printheads as they are developed.

* * * * *